US006746298B1

(12) United States Patent
Doepner et al.

(10) Patent No.: US 6,746,298 B1
(45) Date of Patent: Jun. 8, 2004

(54) TRACK STRUCTURE FOR CONSTRUCTION TOY SET

(75) Inventors: Matthias F. W. Doepner, Harleysville, PA (US); Kenneth Weibel, Ottsville, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 200 days.

(21) Appl. No.: 10/038,744

(22) Filed: Jan. 2, 2002

(51) Int. Cl.[7] ..... A63H 33/26
(52) U.S. Cl. ..... 446/126; 446/446
(58) Field of Search ..... 446/120, 122, 446/126, 85, 93, 96, 105, 108, 111, 444, 445, 446, 489, 124; 104/124, DIG. 1

(56) References Cited

U.S. PATENT DOCUMENTS

| | | | | |
|---|---|---|---|---|
| 3,698,130 A | | 10/1972 | Usami | |
| 5,061,219 A | | 10/1991 | Glickman | |
| 5,118,320 A | | 6/1992 | Miller | |
| 5,137,486 A | * | 8/1992 | Glickman | 446/126 |
| 5,199,919 A | | 4/1993 | Glickman | |
| 5,350,331 A | | 9/1994 | Glickman | |
| 5,368,514 A | | 11/1994 | Glickman et al. | |
| 5,421,762 A | | 6/1995 | Glickman | |
| 5,427,559 A | | 6/1995 | Glickman et al. | |
| 5,913,706 A | * | 6/1999 | Glickman et al. | 446/97 |
| 5,918,999 A | * | 7/1999 | Lamarca | 403/397 |
| 6,220,171 B1 | * | 4/2001 | Hettema et al. | 104/53 |
| 6,286,283 B1 | * | 9/2001 | Kessler | 52/655.1 |
| 6,572,434 B2 | * | 6/2003 | Man | 446/431 |

FOREIGN PATENT DOCUMENTS

| | | |
|---|---|---|
| WO | WO 81/01799 | 7/1981 |

* cited by examiner

*Primary Examiner*—Derris H. Banks
*Assistant Examiner*—Faye Francis
(74) *Attorney, Agent, or Firm*—Schweitzer Cornman Gross & Bondell LLP

(57) ABSTRACT

A track structure for a toy construction set. A box-like structure is formed by a plurality of closely spaced, generally X-shaped track braces, which support elongated tubular flexible track. elements by track supports at the upper extremities of the "X". The track elements have longitudinally extending slots therein to tightly receive the track supports. The track braces are supported and positioned by means of longitudinally extending rods, arranged in parallel relation to the track elements and secured to the track braces by a snap-in engagement of the rods with open-ended gripping sockets formed by the lower extremities of the X-shaped track braces. A plurality of track braces may be mounted on a single pair of rods, and rods may be connected together end to end to make a track assembly of any length. The flexible track elements may be of more or less continuous length. A rugged track structure is formed, which may be shaped in a variety of vertically and/or laterally varying contours by adjustment of the track braces with respect to the rods and track elements. The track structure may also be arranged in a twist configuration by rotationally displacing adjacent track braces. The structure is particularly advantageous for constructing a toy roller coaster or ball track, for example.

19 Claims, 7 Drawing Sheets

TRACK STRUCTURE FOR CONSTRUCTION TOY SET

BACKGROUND OF THE INVENTION

The present invention relates to construction toy sets and more particularly to toy construction sets marketed under the trademark K'NEX, by K'NEX Industries, Inc., Hatfield Pa., US.

Among the multitude of structures which can be built using the K'NEX construction toy set are track structures, useful in various ways, such as in the guidance of rolling balls, the construction of toy roller coaster structures, etc. The Glickman U.S. Pat. No. 5,421,762 is an example of such a track structure. The present invention is directed to improvements in such track structures, enabling building of structures which are more rugged and stable and which can be significantly more complex in nature.

SUMMARY OF THE INVENTION

Track structures of the type contemplated herein can advantageously be constructed utilizing elongated, generally continuous lengths of flexible plastic tubing, formed with a slot along one side to define a track for the support of a guided object. Track supporting elements are inserted radially into the tubular track elements and serve to position and support the track elements in the basic structure. Examples of such construction are shown in the before mentioned U.S. Pat. No. 5,421,762, and also in U.S. Pat. No. 5,368,514, owned by K'NEX Industries, Inc.

Pursuant to the present invention, a novel and improved track structure of the general type referred to above is provided which incorporates a plurality of special track braces, each including an opposed pair of track supports engageable with elongated tubular track elements, for supporting the track elements in a rigid and secure manner at a fixed spacing while accommodating easy configuration of the track in complex shapes.

In a preferred embodiment of the invention, the track braces include a plurality of gripping sockets for axial or crosswise engagement with structural rods of a K'NEX construction set. The track braces advantageously have somewhat of an X-shaped configuration defining four outwardly extending arms. Two such arms are engageable with track elements, and the other two arms form gripping sockets for engagement of structural rods.

In the structure of the invention, a section of track advantageously comprises a plurality of spaced apart track braces, each engaging and supporting a pair of tubular track elements in spaced apart, parallel relation. On the side opposite from the track elements, the track braces engage a pair of elongated structural rods, which also are arranged in spaced apart, generally parallel relation, with the tracks, rods and track braces forming a relatively rigid, box-like structure. The engagement of the track braces with the track elements and with the structural rods is a relatively snug frictional grip, which accommodates longitudinal adjustment of the braces relative to the track elements and rods. This enables the track structure to be easily configured in complex forms, such as turns, loops and twists. In the construction of a toy roller coaster, for example, the track structure may be configured to simulate modern steel tube roller coaster designs, complete with loops, highly banked turns, twists, etc.

In many toy structures, such as in a toy roller coaster, it is desirable to incorporating a lifting chain or the like, to elevate a car to the highest point of the structure. The track structure of the present invention includes features for the accommodation of such lifting chains, providing guidance and support for the chain in a convenient and advantageous manner.

The structure of the invention also can be readily adapted and configured to provide a braking feature for decelerating or stopping a coasting car. For this purpose, a special segment of the track material is installed between the regular tracks in a manner to accommodate controlled deflection such that portions of the deflected track segment engage adjacent elements of a passing coaster car to cause it to be decelerated or, more typically, stopped.

For a more complete understanding of the above and other features and advantages of the invention, reference should be made to the following detailed description of a preferred embodiment of the invention, and to the accompanying drawings.

DESCRIPTION OF A PREFERRED EMBODIMENT

Figure 1:
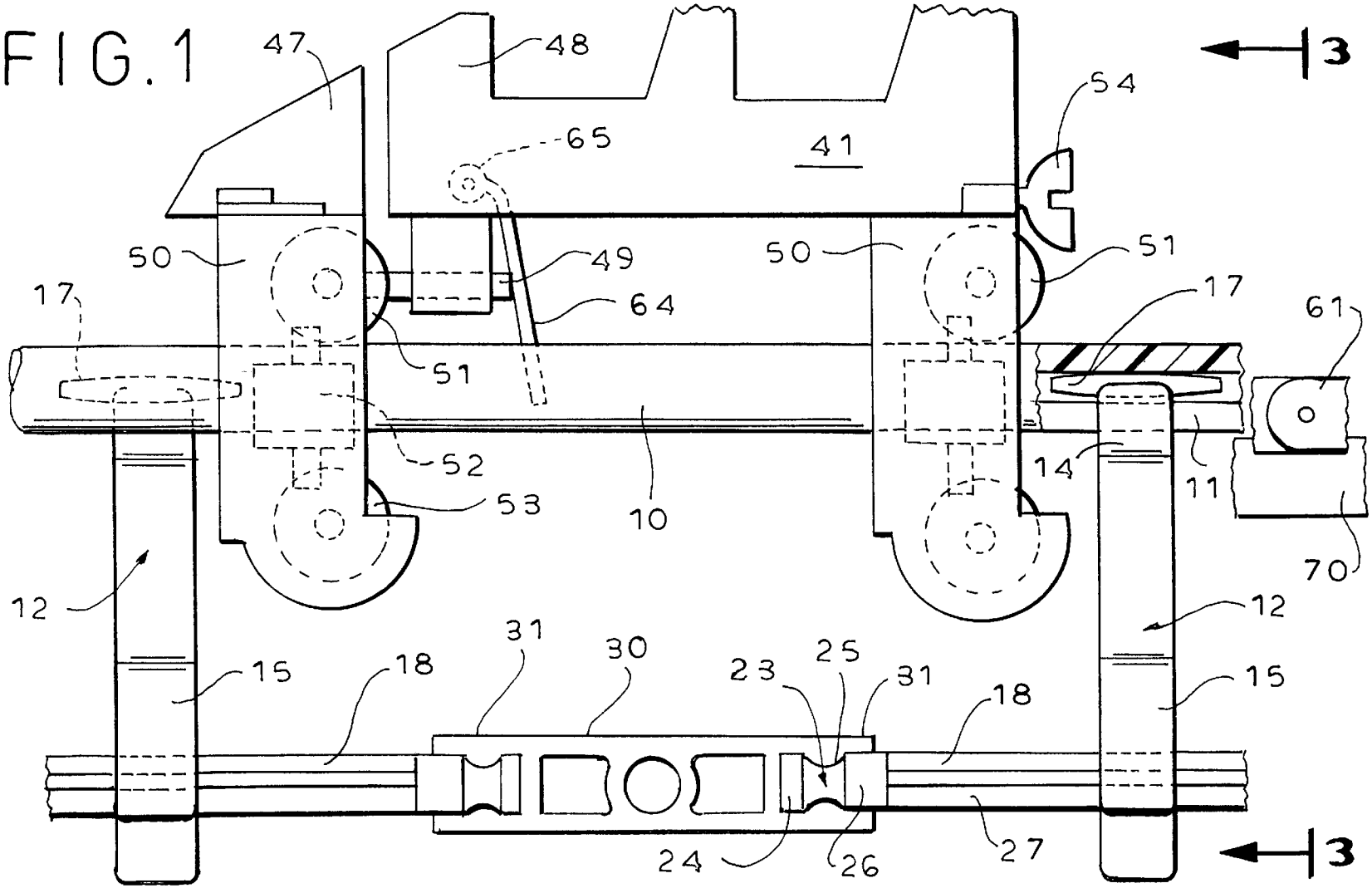
FIG. 1 is an enlarged, fragmentary elevational view, partly in section, illustrating a short section of a track structure constructed in accordance with the invention.

Referring now to the drawings, the reference numeral 10 designates track elements incorporated in the new structure. The track elements preferably are in the form of a continuous extruded tubing of a flexible plastic material, such as polyethylene. The tubing is formed with a slot 11 extending continuously along one side opening into a hollow interior cavity. Pursuant to the invention, a pair of track elements 10 are supported in laterally spaced apart relation by a special form of track brace, designated generally by the reference numeral 12.

Figure 3:
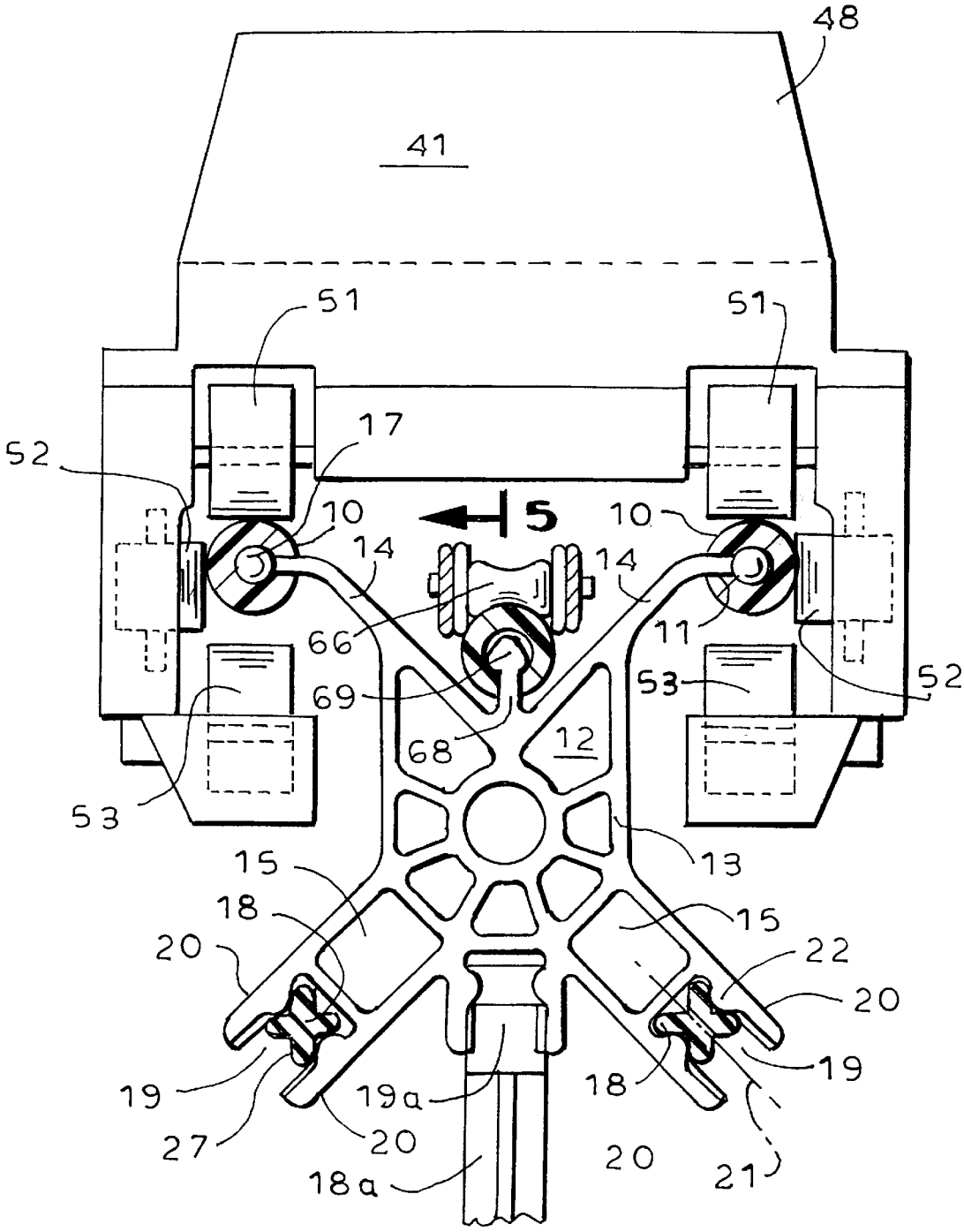
FIG. 3 is a cross sectional view as taken generally on line 3—3 of FIG.
Figure 4:
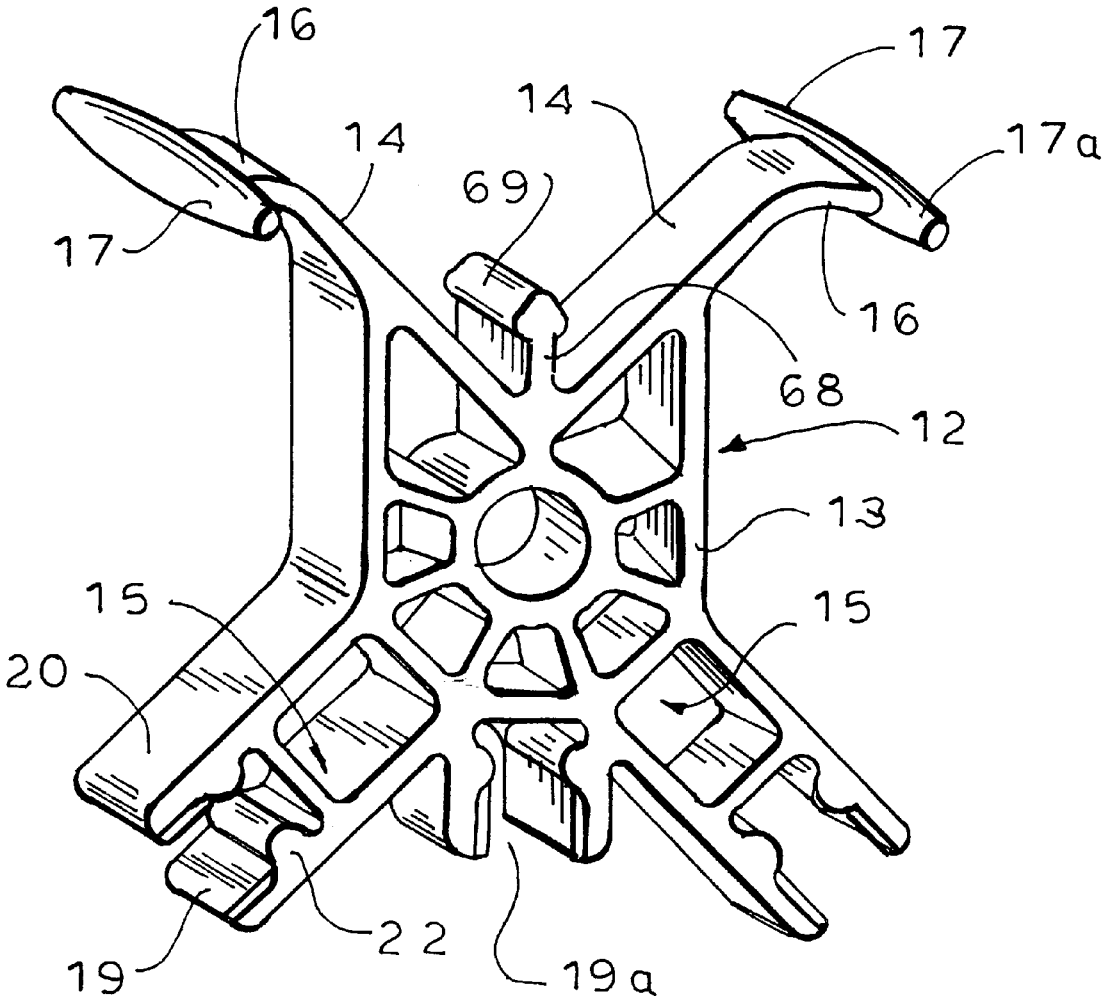
FIG. 4 is a perspective view of a novel and advantageous track brace member which is incorporated in the track structure of the invention.

As illustrated particularly in FIGS. 3 and 4, the track brace 12, of which there may be a substantial plurality in a complete track installation, advantageously are formed of molded plastic, using a strong material such as Celcon M270, an acetal copolymer made available by Hoechst Celenese, Chatham, N.J. The braces include a central body portion 13 mounting in its upper portion a pair of upwardly and outwardly extending track support arms 14, arranged in a generally V-shaped configuration. A pair of rod-gripping socket arms 15 extend in a generally downward and outward direction from the bottom of the body portion, mote or less in an arrangement of an inverted V. It should be understood that the reference to specific orientations, such as upward and downward, are relative and for ease of description only, inasmuch as the track braces and other elements may be installed in a variety of orientations.

The upper extremities of the track support arms 14 are provided with extensions 16, projecting laterally outward and mounting elongated dowels 17 at their outer ends. As reflected in FIG. 4, for example, the main portions of the track brace 12, comprising the central body 13, the track support arms 14 and the gripping sockets 15 are preferably formed in a relatively flat configuration, having a thickness of, for example, about ¼ inch. The dowels 17, which extend in the thickness direction of the track brace, and preferably are somewhat longer (e.g., 0.60 inch in overall length) than the principal thickness of the remainder of the track brace. To advantage, the dowels 17 are of a generally circular cross section and are tapered somewhat at each end, as at 17*a*. The dowels 17 are arranged to be inserted laterally into the tubular track elements 10, through the slots 11 therein. As indicated in FIG. 3, the diameter of the dowels 17 is somewhat greater than the normal dimensions of the track slots 11, such that the track elements initially have to be distorted somewhat as the dowel elements are forced through the slots. Thereafter, the natural resilience of the tubular track elements causes the slots to close around the dowels, attaching the track elements firmly to the arms of the track brace units 12.

In a track structure of the invention, more or less continuous sections of elongated track 10 are mounted upon a series of spaced apart track braces 12, generally in the manner indicated in FIG. 1. The track braces are mounted and positioned by inserting structural rods 18, in a sideways orientation, into open ended gripping sockets 19 formed at the end of the socket arms 15. Both the gripping sockets 19 and the structural rods 18 are of the type customarily utilized in K'NEX construction sets and disclosed and claimed in prior U.S. Pat. Nos. 5,061,219, 5,137,486, 5,199,919 and 5,350,331, the disclosures of which patents are incorporated herein by reference.

The gripping sockets 19 include opposed, resiliently deflectable gripping arms 20 mounted in cantilever fashion in symmetrical relation to an axis 21 of the socket arms 15. Locking projections 22 extend inwardly from the gripping arms 20 dividing the gripping socket into inner and outer portions.

The structural rods 18 are formed with specially configured end portions 23 comprised of a cylindrical end flange 24, an annular groove 25 adjacent to the end flange, and a cylindrical gripping portion 26 adjacent to the groove 25 on the side opposite the end flange. The central body portions 27 of the rods 18 are of generally X-shaped configuration, as indicated in FIG. 3.

As set forth in the disclosures of the before mentioned K'NEX patents, the rods 18 may be installed in the gripping sockets 19 in either axial or crosswise orientation. In the illustration of FIG. 3, the rods 18 are installed in the sockets 19 in a crosswise orientation. An additional rod 18*a* is shown installed in a third gripping socket 19*a* in an axial orientation, for purposes later to be described. In either case, whether oriented axially or crosswise to the gripping sockets, the assembly of rod to socket is a snap-in assembly, in a direction lateral to the axis of the rod.

In a typical track installation according to the invention, the rods 18 may be of considerable length, for example, ten inches, and as many as three or four of the track brace elements 12 may be installed on a single pair of rods, with the rods 18 oriented in crosswise fashion in the sockets 19, with the locking projections 22 lodging in V-shaped longitudinal grooves formed in the rods by virtue of the X-shaped cross section thereof. Each track brace is thus arranged to grip a pair of spaced apart rods 18 in a snug, frictional grip that accommodates longitudinal adjustment of the track braces in the length direction of the rods 18 but otherwise holds the track braces in their adjusted positions.

The basic structure of the track, as reflected in FIG. 3, is somewhat box-like, with the rods 18 defining the "bottom" of the box, and the spaced apart track elements 10 defining the "top", with the rods extending parallel to the track elements. This relatively rigid, box-like structure provides for uniform, parallel spacing of the track elements.

Although for many structural purposes, the rods of a K'NEX construction set are formed of rigid material, the rods 18 of the track structure of the present invention, advantageously are formed of a somewhat softer material, such as low density polyethylene. Thus, while the rods normally are straight, they can be shaped to a certain degree to follow desired contours, and held in such contoured shapes by adjustment of the positions of the track braces 12 and/or by association with more rigid support structure.

In a complete structural assembly, the track structure may be in the form of a continuous closed course (e.g., a roller coaster) of considerable length. In order to construct such a lengthy track structure using rods of, for example, ten inches in length, longitudinally adjacent rods may be connected by means of an axial coupling device 30, which is a conventional component of a K'NEX construction set. The coupling device has a pair of opposed, axially aligned gripping sockets 31 of the general type previously described, and a pair of adjacent structural rods 18 is coupled in axial alignment by means of this coupling element. Thus, the rod structure on which a large plurality of track braces 12 are mounted can be as long as necessary.

Figure 2:
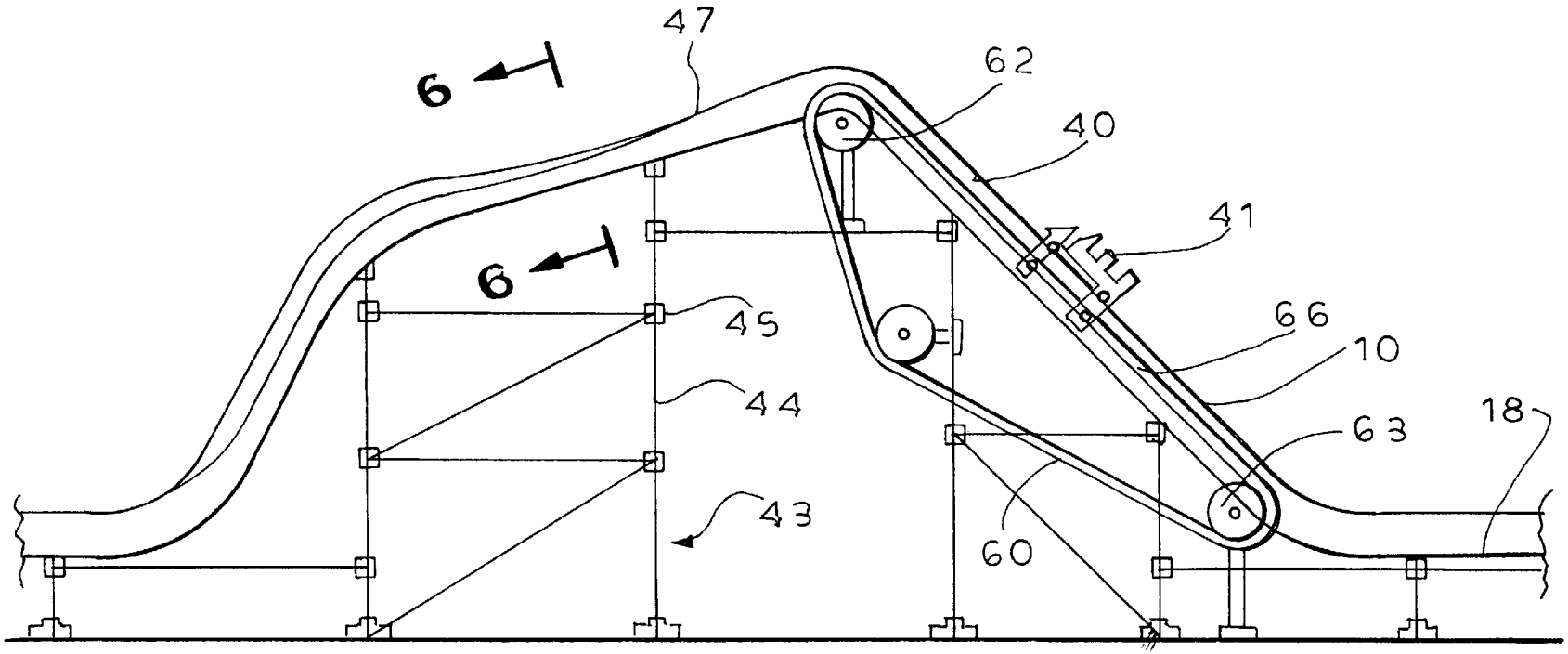
FIG. 2 is a highly simplified, schematic view of a toy roller coaster or like structure constructed with the track structure of the invention.

A typical structure incorporating the track structure of the invention may be in the form of a roller coaster, for example, as schematically indicated in FIG. 2. Spaced apart flexible track elements 10, mounted on a large plurality of the track braces 12, extend around a large closed course (not shown) including a lifting portion 40, in which a coaster car 41 is elevated to a position of maximum height, and a gravity portion 42, comprised of a plurality of contoured track sections, including turns and loops and twists, as determined by the coaster designer. The track elements 10 and a plurality of connected-together rod elements 18 (in all cases comprised of track sections of a structure shown in FIGS. 1–3), are supported by a rigid understructure 43 comprised of conventional structural elements including rigid rod elements 44, coupling connectors 45, etc., all as well known in the K'NEX construction toy product and as described in the before mentioned patents.

Mounting of the box-like track structure to the rigid understructure is accomplished in different ways. One of those ways is to install a supporting rod in selected ones of the gripping sockets 19*a* of the track braces 12. For example, as shown in FIG. 3, a rod 18*a* is installed in axial orientation in the gripping socket 19*a*. A rod section of the support structure could also be installed crosswise in the socket 19*a*, in the same manner as the primary rod sections 18. Alternatively, any of a variety of K'NEX connector elements, which comprise one or more of the gripping sockets as disclosed in FIG. 3 can be attached in crosswise orientation to any of the rods 18 at any point along their length in order to integrate the track structure into the underlying support structure. See, by way of illustration, FIG. 6, in which a coupling element 46 of the supporting structure is shown attached to rod 18 of the track structure.

In order to impart contours to the track, such as in curves and loops, for example, the positions of the various track braces 12 may be adjusted to vary the spacing between certain portions thereof relative to other portions thereof. In a complete track installation, for example, which may involve a total track length of ten to twelve feet or more, the track braces may be spaced apart on an average of two to three inches, for example, typically being spaced more closely together in areas of contoured track, as compared to areas of straight track. In a series of sections of the general type shown in FIG. 1, for example, by displacing lower portions of a series of adjacent track braces 12 to have a closer spacing along the rods 18 than along the tracks 10, the track structure is caused to assume a convex track contour. If the spacing between lower portions of the track braces is enlarged, relative to the spacing between upper portions of the braces, the track 10 will be caused to assume a concave track contour. In a similar manner, by changing the track brace spacing at one side of the structure relative to the other, the track can be curved left or right. Combinations of these spacings can be employed to achieve compound curvatures, where the track is simultaneously curving left or right and up or down. The relatively rigid support structure for the track assembly can also play a part in the track contours, by supporting and retaining the track in its intended contours.

In addition to lateral and vertical contouring, the track structure of the invention can also be configured in a twisted manner, enabling a roller coaster structure, for example, to be constructed with steeply banked turns and the like for a high degree of realism. In order to provide a twisted contour, adjacent track braces 12 are rotationally displaced, as reflected in FIG. 6. Typically, the underlying rigid support structure 43 is utilized to retain a series of longitudinally adjacent track braces 12 in rotationally displaced orientation. In this respect, a pair of brace elements, spaced a substantial distance apart, may be held in rotationally displaced positions, and the several track braces in between will be progressively rotationally displaced from the beginning position to the end position by reason of the continuity of the flexible track elements 10 and the semi-flexible rod elements 18, forming the box-like track structure.

Regardless of the contouring of the track structure, whether horizontal, vertical or rotational, track spacing is accurately maintained, and a smooth running track contour is provided because of the cross sectional rigidity of the box-like configuration.

Although the track structure of the invention is in no way limited to the construction of roller coasters, for example, it is evident that the structure is uniquely adapted for that purpose. In the illustration of FIG. 1, a coaster car 41 for a roller coaster structure or the like is guided and supported on the track elements 10. The illustrated coaster car 41 is designed to be the lead car of a multi car coaster unit. Because of the twisting contours of the track, the car 41 is formed in two sections 47, 48 connected by a longitudinal pivot pin 49 which allows the front section 49 to twist relative to the back section 48, about the axis of the pin 49. Each car section 47, 48 is provided with a wheel truck 50 which is fixed to the car section and supports three wheels at each side. Thus, each truck has a pair of upper wheels 51, a pair of side wheels 52 and a pair of lower wheels 53. These wheels embrace the opposed track sections 10 as shown in FIG. 3, so that the coaster car will have rolling engagement with an opposed pair of track elements 10 in any condition or orientation of the track, around sharp curves, in steeply banked areas, or even upside down. One or more trailing cars (not shown) may be attached to the lead car 41 by way of a universal coupling element 54. The trailing cars need only one wheel truck and thus are able to twist and bend relative to the car or cars in front and back.

Figure 5:
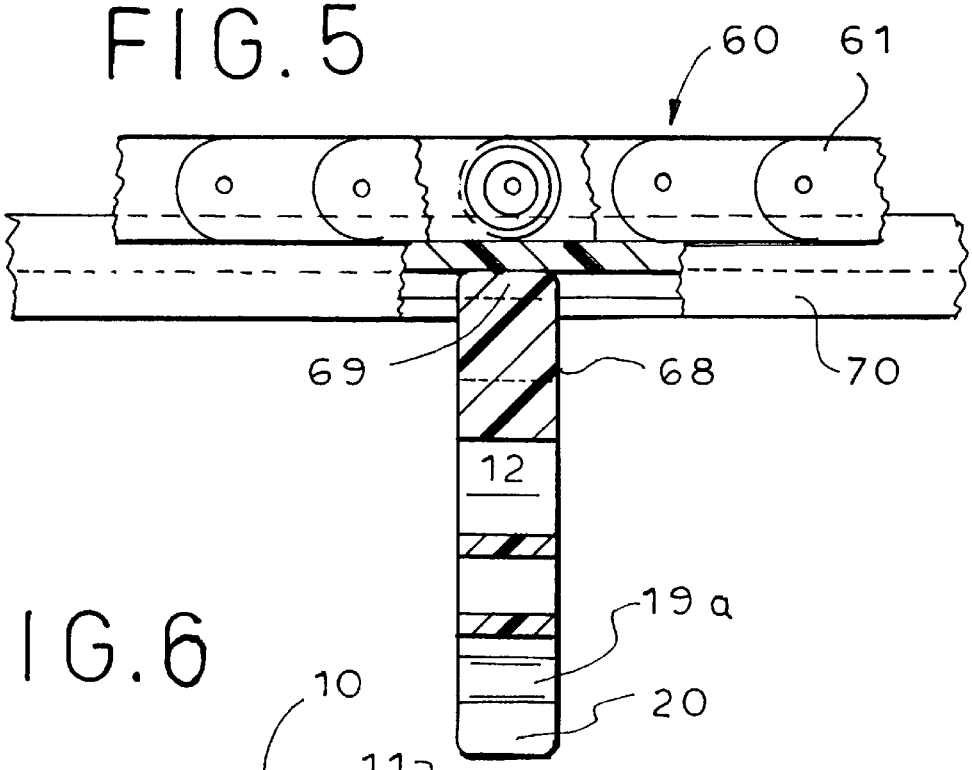
FIG. 5 is a fragmentary cross sectional view as taken generally on line 5—5 of FIG. 3, illustrating a chain support feature that may be incorporated into certain sections of the track structure.

In a working toy roller coaster assembly, it is desirable to provide means for elevating the coaster cars to the highest point of the structure. For this purpose, it is convenient and advantageous to utilize a chain structure of the type described and claimed in U.S. Pat. No. 5,427,559, the disclosure of which is incorporated herein by reference. A continuous loop chain 60 of the type described is comprised of a plurality of pivotally connected chain links 61 (FIG. 5). Sprockets 62, 63 are incorporated into the roller coaster structure and define a generally straight line path from the bottom to the top of the first elevation of the track. At least one of the sprockets 62 or 63 typically will be driven by a motor (not shown) which is either continuously operating or operator controlled. Engagement of the coaster cars 41 with the lifting chain 60 advantageously is effected by a drive arm 64 (FIG. 1) which is pivotally mounted at 65 on the coaster car and normally hangs downward by gravity to a position to be engaged by cross elements 66 of the lifting chain. Suitable abutment means limits the downward pivoting motion of the drive arm 64 to that shown in FIG. 1. The arm may, however, freely pivot upwardly, in a counterclockwise direction. When the lead car 41 is placed over the upwardly moving section 67 of the lifting chain, the drive arm 64 is engaged by a link of the chain and the car is propelled up the inclined track section by the moving chain.

In order to assure proper driving contact between the lifting chain and the drive arm 64 throughout the entire upward travel of the coaster car, it is advantageous to provide positive guidance and support for the chain. For this purpose, the track brace elements 12 advantageously are provided with upwardly projecting auxiliary track supports 68, which extend upwardly from the body portion 13 along a vertical center line bisecting the angle between the track support arms 14. The upper extremities of the auxiliary track supports are formed with an upwardly tapering enlargement 69, shown best in FIG. 4. An auxiliary track section 70, formed of a length of the same flexible plastic tubing utilized for the main track elements 10, is installed over the auxiliary track supports 68, extending underneath the chain section 66, throughout substantially the entire distance between the upper and lower sprockets 62, 63. Over this extent, the auxiliary track element 70 will be supported by a multitude of track brace elements 12, as will be understood.

As reflected particularly in FIG. 3, the auxiliary track element 70 provides a relatively straight line guidance and support for the chain traveling above it, throughout the entire length of the auxiliary track section, as the chain advances the coaster car up to the lifting portion 40.

Although the auxiliary track supports 68 are required only in the area in which the auxiliary track element 70 is installed, it is convenient, as a practical production matter, to provide such auxiliary supports on all of the track braces 12.

Figure 6:
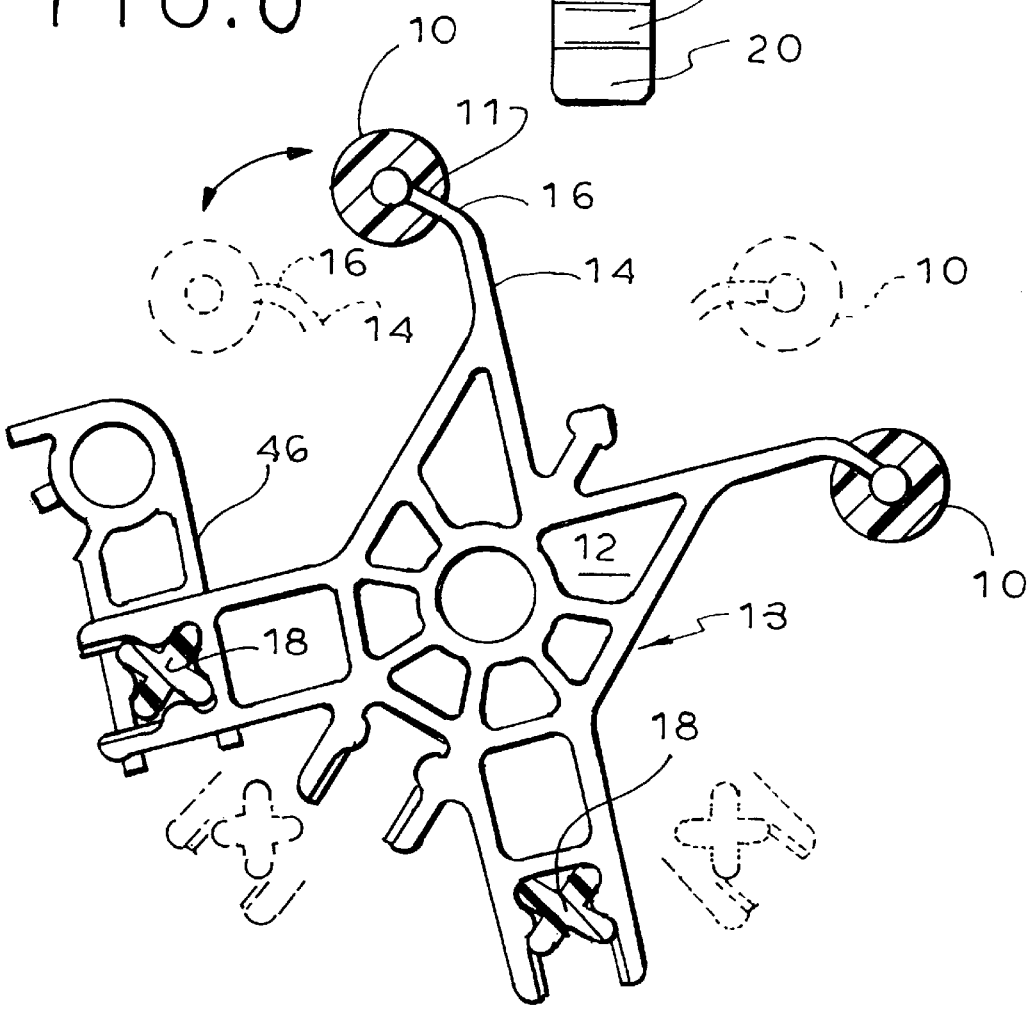
FIG. 6 is a simplified cross sectional representation illustrating the manner in which successive track brace elements may be rotationally oriented to form twisted track structures.
Figure 7:
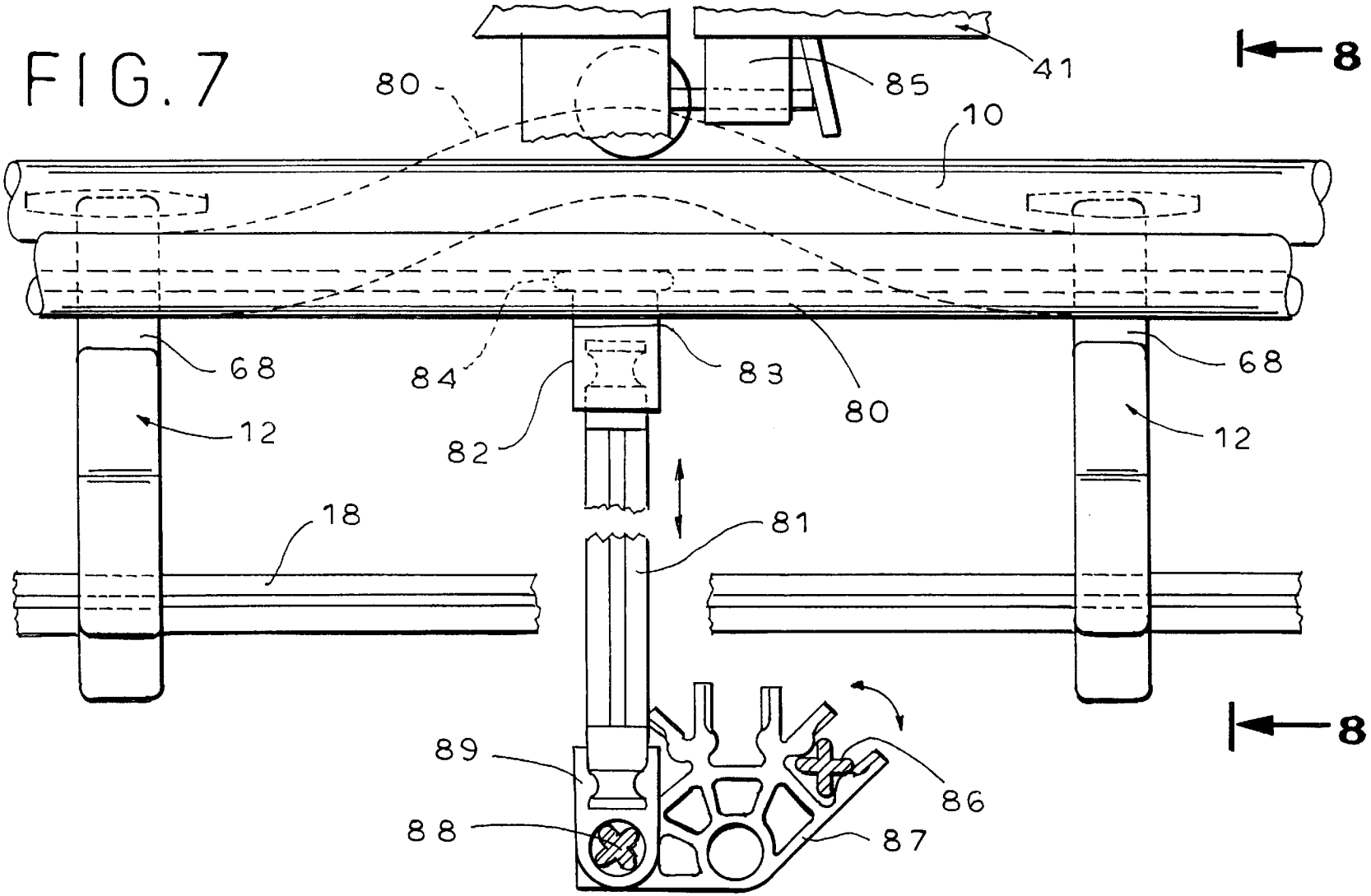
FIG. 7 is an enlarged fragmentary view, partly in section, illustrating a short section of track incorporating a brake feature for use in stopping or decelerating passing cars.

Referring now to FIGS. 6 and 7 of the drawing, there is illustrated a braking feature, by which a coaster car may be conveniently stopped or decelerated. In FIG. 7, there is shown a segment of track structure as previously described, comprising a pair of spaced apart track braces 12 joined by structural rods 18 and mounting spaced apart track elements 10 supporting a coaster car 41 by its wheel sets 51, 53 (see FIG. 3).

A brake feature is provided by installing a short track segment 80 on auxiliary track supports 68 of an adjacent pair of track braces 12. The track braces 12 on which the special track segment is mounted preferably are provided in a relatively straight section. of the track, enabling the track braces to be spaced a reasonable distance apart.

Figure 8:
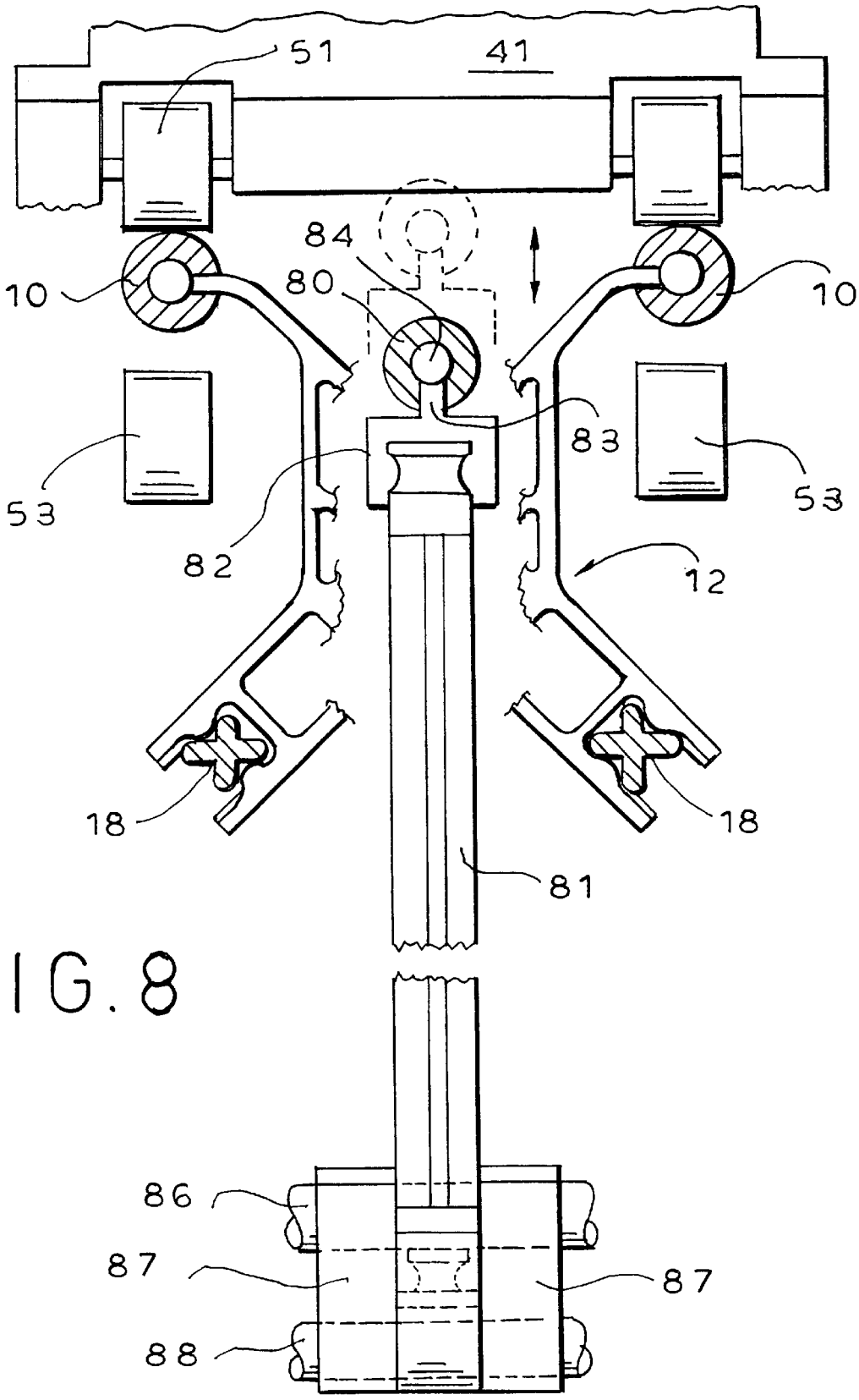
FIG. 8 is a cross sectional view as taken generally on line 8—8 of FIG. 7, with parts broken away.

The special track segment 80 is of the same general material used for the primary tracks 10 and is thus relatively flexible and can be elastically displaced in the span between the adjacent track braces 12 shown in FIG. 7. For this purpose, a brake actuating rod 81 is provided which carries a track-engaging connector 82 at its upper end. The connector 82 has a relatively thin section 83 adjacent its outer end, which mounts a dowel portion 84. The dowel portion 84 is inserted into the center of the flexible track member 80, generally as shown in FIG. 8, such that the connector 82 is effectively locked together with the special track segment 80. Preferably, this is done at a location centrally intermediate the two track braces 12 adjacent opposite ends of the track segment 80, as indicated in FIG. 7.

By actuating the actuator rod 81 upwardly, as viewed in FIG. 7, the track segment 80 is displaced upwardly from its at rest position, which is somewhat below the level of the main track elements 10, as is evident in the drawings. At a predetermined elevational displacement, upper surfaces of the track segment 80 will interfere with portions of the undercarriage of the coaster car 41. In the illustration of FIGS. 7 and 8, the car 41 incorporates a downwardly projecting member 85 which will contact upper surface portions of the special track segment, when the latter is in its displaced position as indicated in dotted lines in FIGS. 7 and 8. Depending on the extent of the interference, this will result in either deceleration or total stoppage of the car, as desired.

Although any suitable mechanism may be provided for controlled displacement of the actuator rod 81, the mechanism illustrated in FIGS. 7 and 8 incorporates for this purpose a rotary control rod 86, which is suitably mounted in the structure for rotational movement, by motor, lever, etc. (not shown). A connector 87 is fixed to the rotation shaft 86 and carries a rod 88 at its opposite end. The rod 88 is joined by a coupling device 89 to the lower end of the actuator rod 81. The arrangement is such that rotation of the control rod 86 will cause the rod 81 to be controllably moved upward and downward between a retracted position, shown in full lines in FIGS. 7 and 8, and an upwardly displaced position, shown in broken lines.

The invention provides a uniquely advantageous track structure for toy building sets, with easy to assemble, snap-in connections. The track structure provides a sturdy yet universally configurable track arrangement, in which a pair of flexible tubular track elements, of more or less continuous lengths, are supported in uniformly spaced parallel relation, in a rugged box-like structure while being easily formed into curves, humps, valleys, loops, twists, etc.

The X-shaped configuration of the track brace elements enables the track structure to have a desired box-like configuration, while providing for wheel engagement on the top, bottom and opposite sides of the opposed rails. This enables a roller car to be guided along the track structure in any degree of tilt, around sharp corners, even upside down, enabling toy roller coaster structures to be constructed which simulate the realism of modern steel tube roller coaster installations.

The structure of the invention enables a useful brake feature to be easily incorporated into a roller coaster or similar track device involving a coasting car. By mounting a special segment of the special track tubing between two spaced apart track braces, arrangements can easily be made for controllably displacing the special track segment into an interfering position with respect to a coaster car supported on the adjacent track rails. The arrangement is ideally suited for incorporation in a K'NEX construction set, for example, where simplified lever mechanisms can be easily constructed to effect the desired controlled displacement of the special track segment.

While one of the most useful applications of the invention is in the construction of toy roller coasters, it will also be understood that the new track structure may be utilized to great advantage in other structures such as arrangements which provide for the guided gravity movement of balls, for example.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A track structure for a construction toy set, which comprises (a) a pair of flexible, tubular track elements, each having a hollow interior and being formed with a longitudinally extending slot, (b) said track elements being arranged in uniformly spaced apart parallel relation, (c) a plurality of track braces, spaced apart in a longitudinal direction of said track elements and disposed generally perpendicular to said track elements, (d) each said track brace comprising a unitary plastic molding and having a central portion from which extend a pair of spaced apart track support arms, each carrying at an outer extremity thereof a track-engaging element received in the interior of a track element through the longitudinal slot therein for mounting a pair of track elements in predetermined, spaced apart relation, (e) each said track brace having a pair of spaced apart rod-gripping sockets on a side of said body portion generally opposite to said track engaging elements, (f) a plurality of structural rods of plastic material, (g) at least certain of said structural rods being disposed generally parallel to said track elements and being engaged in rod-gripping sockets of two or more of said track braces, (h) a combination of said tubular track elements and said plurality of track braces engaging said track elements, and said certain ones of said structural rods engaged by said rod-gripping sockets, forming a coherent structural unit for guiding and positioning said track elements.

2. A track structure according to claim 1, wherein (a) said central portion, said track support arms and said rod-gripping sockets are disposed transversely with respect to said track elements, and (b) said track engaging elements are of elongate configuration integrally fixed to said track support arms and aligned longitudinally with said track elements.

3. A track structure according to claim 1, wherein (a) said rod-gripping sockets each comprise a pair of spaced-apart gripping arms forming a gripping socket, (b) said gripping sockets have a socket axis disposed transversely with respect to said track elements, and (c) said structural rods are frictionally engageable with said gripping sockets alternatively transversely of or coaxial with the axis of a rod-gripping socket.

4. A track structure according to claim 3, wherein (a) at least certain ones of said track braces are formed with at least one rod-gripping socket, in addition to said pair of spaced apart gripping sockets, for receiving a structural rod to support and position said track structure.

5. A track structure according to claim 2, wherein (a) the central portions, track support arms and rod-gripping sockets of said track braces have a principal plane perpendicular to said track engaging element, (b) said track braces are of relatively flat configuration and principally of a predetermined thickness in a direction parallel to said track engaging elements, and (c) said track engaging elements are of greater length than said predetermined thickness.

6. A track structure according to claim 3, wherein (a) each of said pairs of gripping arms is formed with locking projections extending into a space between said gripping arms, (b) said structural rods having a transverse dimension suitable to fit snuggly between the gripping arms of a pair, (c) said structural rods having a rod axis and having at least portions thereof along a length thereof of a generally "X"-shaped cross section defining opposed pairs of longitudinally extending grooves, (d) said rods being engageable in a gripping socket with the rod axis disposed at right angles to the socket axis, and with said locking projections engaged with an opposed pair of longitudinally extending grooves to accommodate adjustable positioning of said track braces longitudinally with respect to said rods.

7. A track structure according to claim 6, wherein (a) said rods have, adjacent opposite ends thereof, annular grooves, (b) said rods being alternatively engageable with said gripping sockets with said rod axes aligned with the axis of the gripping socket in which they are received, and (c) said locking projections are engaged with said annular grooves when said rods are engaged with a gripping socked with the rod axis and socket axis aligned.

8. A track structure according to claim 7, wherein (a) an adjacent pair of said track braces in a structure are joined by at least one structural rod engaged in a gripping socket of each track brace and disposed perpendicular to the socket axis of such gripping socket, and (b) at least certain of said track braces have at least one additional gripping socket available for the engagement of a rod disposed therein with its axis aligned with the axis of such socket.

9. A track structure according to claim 1, wherein (a) an additional track engaging element is positioned generally centrally between said first-mentioned track engaging elements, and (b) an additional flexible, tubular track element is provided having a hollow interior and formed with a longitudinally extending slot, (c) said additional track element being engaged and supported by said additional track engaging element and extending parallel to said first-mentioned track elements.

10. A track structure according to claim 9, wherein (a) at least a portion of said track structure is disposed on an incline, (b) a drive chain is disposed for movement of a section thereof along said inclined portion for movement of a track guided vehicle upwardly over said inclined portion, and (c) said drive chain section is positioned to extend above and be supported and guided by said additional track element.

11. A track structure according to claim 10, wherein (a) said first-mentioned track engaging elements define a first plane, and (b) said additional track engaging element is positioned to support said additional track element in a position offset from said first plane.

12. A track structure according to claim 9, wherein (a) said track support arms extend from said central portion outward and upward at a substantial angle to each other, such that, when a track brace is disposed in a generally upright orientation and said first mentioned track engaging elements are disposed in the same horizontal plane, said track support arms extend upward and laterally outward from said central portion, whereby upper, lower and outer surface portions of said first-mentioned track elements are accessible for wheel engagement by a track guided vehicle.

13. A track structure according to claim 12, wherein (a) said rod-gripping sockets extend from said central portion in directions generally opposite to said track supports to impart a generally "X"-shaped configuration to said track braces.

14. A track structure according to claim 1, wherein (a) in a structure comprised of a plurality of track braces, said certain of said track braces are rotationally displaced from adjacent track braces in order to impart rotational twist to said track structure.

15. A track structure according to claim 14, which includes (a) a multi-segment track guided vehicle engageable with said track elements, (b) each segment of said vehicle being connected to another segment by coupling means providing universal pivoting and rotational movement of one segment relative to an adjacent, connected segment, (c) each segment of said vehicle having laterally spaced apart opposed wheel groups for engagement with said track elements, (d) said wheel groups each comprising at least two wheels mounted on axes disposed at a substantial angle to each other, whereby engagement of a spaced apart pair of said track elements by an opposed pair of wheel groups of a vehicle segment secures said vehicle segment to said track elements while accommodating movement in the longitudinal direction of said track elements.

16. A track structure according to claim 1, wherein (a) a car supported on said track elements, (b) a separate segment of flexible tubular track is mounted on and extends longitudinally between a pair of adjacent track braces, between and generally parallel to said tubular track elements, (c) a generally central portion of said separate track segment, between said last mentioned pair of track braces, being controllably flexibly displaceable in a direction toward said car, for making braking contact with said car.

17. A track structure according to claim 16, wherein (a) a displacement element is positioned to engage said separate track segment, (b) said displacement element being controllably movable to effect displacement of said track segment.

18. A track structure according to claim 16, wherein (a) said car is supported primarily on upper surface portions of said track elements, and (b) said separate track segment is displaceable upwardly into braking contact with said car.

19. A track structure according to claim 16, wherein (a) an additional track engaging element is positioned generally centrally between said first-mentioned track engaging elements, and (b) said separate track segment has a hollow interior and formed with a longitudinally extending slot, (c) said additional track element is engaged and supported by said additional track engaging element and extends parallel to said first-mentioned track elements.

* * * * *